United States Patent [19]

McManus

[11] Patent Number: 5,020,867

[45] Date of Patent: Jun. 4, 1991

[54] PORTABLE SERVING AND STORAGE CABINET

[76] Inventor: James A. McManus, 21219 So. Figueroa St., Carson, Calif. 90745

[21] Appl. No.: 550,290

[22] Filed: Jul. 9, 1990

[51] Int. Cl.[5] ..... A47B 77/00

[52] U.S. Cl. ..... 312/314; 312/317.3; 312/282; 312/140.2; 312/239

[58] Field of Search ..... 312/140.2, 140.3, 313, 312/314, 317.3, 282, 195, 239, 194

[56] References Cited

U.S. PATENT DOCUMENTS

| | | | |
|---|---|---|---|
| 658,999 | 10/1900 | Scannell | 312/282 X |
| 1,195,964 | 8/1916 | Bradley | 312/314 X |
| 2,122,969 | 7/1958 | Whitcomb | 312/314 X |
| 2,813,769 | 11/1957 | Post | 312/313 X |
| 4,536,044 | 8/1985 | Ziegelheim et al. | 312/195 |

*Primary Examiner*—Joseph Falk
*Attorney, Agent, or Firm*—Roger A. Marrs

[57] ABSTRACT

A portable cabinet is disclosed having wheeled housing with an internal storage compartment separated by midsection into an upper compartment including an open sink area, a glassware area and a supply area and into a lower compartment having a refrigerator area and food or bottled drink storage areas. The primary feature resides in a pair of pivotally mounted panels on the cabinet having a closed position of covering the upper and lower compartments respectively and having an unfolded or open position wherein the upper mounted panel is deployed as a counter and the lower mounted panel is deployed as a support for the upper panel when used as a counter.

4 Claims, 1 Drawing Sheet

PORTABLE SERVING AND STORAGE CABINET

BACKGROUND OF THE INVENTION

1. Field of the Invention

The present invention relates to the field of portable cabinets, and more particularly to a novel serving and storage cabinet having internal storage compartments which are covered and closed by panels for storage purposes and wherein the panels are deployed when opening the cabinet to provide a serving counter and a support therefor.

2. Brief Description of the Prior Art

In the past, it has been the conventional practice to provide portable cabinets which enclose a variety of foodstuffs, bottled goods, serving trays, stemware, disposal pans or the like. Usually such cabinets include a wheeled base having closed compartments that are readily opened in order to expose the interior for removal of items or for the introduction of items thereto for storage. Such cabinets are generally referred to as serving carts and in some instances, include a pivotal cover which merely opens and closes the storage area, such as a door, lid or cover. In these latter instances, the pivoted member does not serve any functional service when the cabinet has been opened and the sole purpose of the member is to cover or close the storage compartment per se.

A further problem associated with prior portable cabinets is that such cabinets do not include a serving counter which is deployable between open and closed positions having a functional usage in either of the positions. Although such carts may include pivoting flaps or table portions which are merely moved from the sides of the cabinet to an outwardly projecting position and employing a pivoting member to support such a flap, the flap or folding portion serves no purpose when in the closed or in its non-operative position.

Therefore, a long-standing need has existed to provide a novel portable cabinet having a plurality of storage compartments which are arranged in groups and wherein one group of internal storage cabinets is closed by a pivoting panel member, while the other group of storage cabinets is closed by a second pivoting panel member. Both panel members serve to enclose the compartments when it is desired to move or seal the compartments and yet when the panels are deployable into functional orientation, one panel serves as a counter while the other panel serves as a support for the counter. Such a portable cabinet would be extremely useful in attending to the needs of persons in small groups or parties in areas not having permanent sink, refrigeration or storage facilities. Such areas may be poolside, garden areas or conference room settings.

SUMMARY OF THE INVENTION

Accordingly, the above problems and difficulties are obviated by the present invention which provides a novel wheeled cabinet having an upper and a lower storage compartment that are closed by upper and lower panel members pivoted on the cabinet between the closed position and an open position. The upper pivoting panel is characterized as being of an L-shaped configuration in plan view so as to function as a counter with serving personnel directly behind the counter and in front of the face of the cabinet while the lower pivoting panel is deployable to an open position below the upper panel so that it will support the upper panel once so deployed. The lower panel is configured from a pair of panel portions which are hingably carried along edge marginal regions so that the lower panel will suitably support the L-shape of the counter.

Other features include the provision for refrigerator, sinks, trays, icemakers, glassware storage and the like and wherein suitable plumbing is provided to interconnect the variety of water or drainage systems.

Therefore, it is among the primary objects of the present invention to provide a novel wheeled cabinet having panel means deployable between a first position enclosing the storage compartments and a second position outwardly extending from the face of the cabinet constituting a counter and a support therefor.

Another object of the present invention is to provide a novel wheeled cabinet having a plurality of storage cabinets which include accessory items such as refrigeration, sinks, icemakers or the like, and wherein such compartments are closed by pivoting panels serving as closures for storage in a first position and serving as a counter and support therefor in a second deployed position.

Still another object of the present invention is to provide a novel serving cabinet not only having a variety of serving capabilities but including pivoting counter and support therefor whereby serving personnel have ready access to the storage compartments in the cabinet per se and may employ the counter surface for serving personnel on the opposite side thereof.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
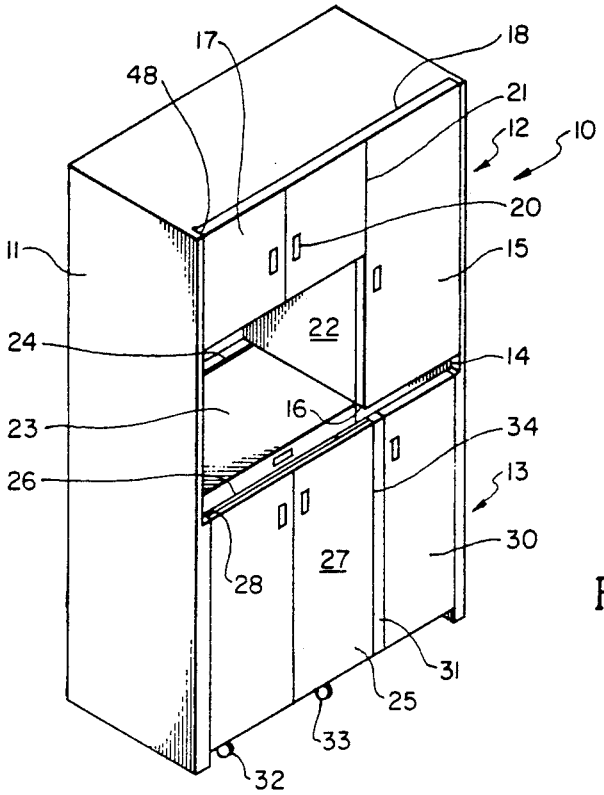
FIG. 1 is a front perspective view showing the novel portable serving and storage cabinet of the present invention.

Referring to FIG. 1, the novel portable cabinet of the present invention is illustrated in the general direction of arrow 10 which includes an elongated, upright housing 11 having opposite sides and a top which define a storage compartment therebetween. The storage compartment is divided between an upper compartment 12 and a lower compartment 13 by a midsection member 14. The upper storage compartment 12 includes a single panel 15 which is a L-shaped configuration having a terminating end hingably attached to the member 14, as indicated by numeral 16. The panel 15 includes a lateral section 17 that projects across the face of the cabinet adjacent to the top to terminate at one side thereof. It can be seen that the top is notched, as represented by numeral 18, to receive the thickness of the panel 15 and to emphasize that the panel is of integral construction.

One side of panel 15 which is the outward exposed surface, includes handles, such as indicated by numeral 20, and scorelines, as indicated by numeral 21, that represent cabinet doors but, in fact, are only representations and do not provide for operating doors or handles.

The panel 15 is of L-shape configuration so as to expose an opening 22 within the storage department so that access may be had to a cutting board or working surface 23 that is hinged to the cabinet, as indicated by numeral 24. A sink and condiment tray are installed immediately beneath the board 23 so that when it is raised, the sink and tray are exposed.

The lower storage compartment 13 is closed by a panel 25 that is composed of panel portions 26 and 27 that are connected together at their adjacent sides by a hinge 28. A separate hinged door 30 completes the closure of the lower storage compartment 13 and the door 30 is separate from the panel 25 by a structural intermediate member 31. Wheels 32 and 33 permit the panel 25 to be moved from its closed position to its open or operative position by means of a hinge 34 coupled to the intermediate member 31.

Therefore, in FIG. 1 it can be seen that the storage cabinet 11 is in its completely closed position with the L-shaped panel 15 closed against the face of the cabinet with one end received within the notch 18 at the top. The panel 25 is also closed with panel portions 26 and 27 in coextensive relationship against the face of the cabinet. The board 23 is in its closed position covering the sink and condiment tray. Even in the storage or closed position, the cabinet may be used for limited service by raising the board 23 to expose the sink and condiment tray and the compartment behind door 30 may be utilized in a convenient manner.

Figure 2:
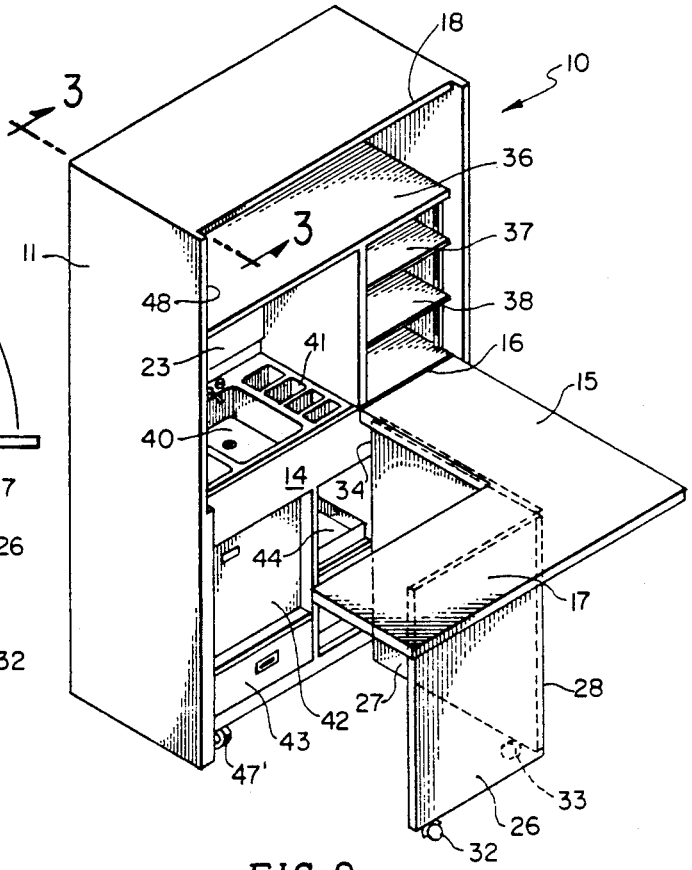
FIG. 2 is a view similar to the view of FIG. 1 illustrating the pivoting, panels fully deployed into the supported counter configuration.

Referring now in detail to FIG. 2, the panels 15 and 25 are illustrated in their fully deployed or operative position in which the panel 15 serves as a counter on which food, beverage or the like may be placed for serving personnel about the outer periphery. It is to be particularly noted that because of the L-shaped configuration of the panel, an open space is provided between the face of the cabinet and the extended portion 17 of panel 15 so that serving personnel may operate behind the counter when so deployed.

In order to properly support the counter panel 15, the under panel 25 is pivoted about hinge 34 and panel 26 is pivoted with respect to panel 27 by means of hinge 28 so that both panels will open underneath panel 15 and will support both the major length of the panel and the portion 17. By deploying both panels, the upper and lower storage compartments 12 and 13 are fully exposed so that the server behind the counter 15 may have access to a shelf 36 on which glass stemware can be placed or to glass shelves 37 and 38 on which other implements, utensils or the like may be stored. A sink is indicated by numeral 40, while the condiment tray having four or five compartments, is indicated by numeral 41 adjacent to the sink 40. A refrigerator 42 is indicated in the lower storage compartment and a drawer 43 may be installed beneath the supporting shelf for the refrigerator. An ice tray or the like is indicated by the numeral 44, and any other suitable appliances may be placed behind door 30. It is to be understood that a variety of appliances which may include microwave ovens, television sets, radios or the like may be placed in the respective storage areas within the storage compartment.

Figure 3:
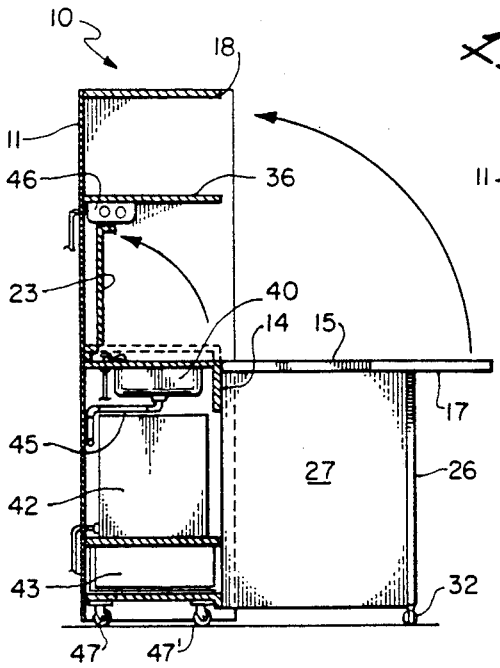
FIG. 3 is a transverse cross-sectional view of the portable cabinet shown in FIG. 2 as taken in the direction of arrows 3—3 thereof.

As shown more clearly in FIG. 3, suitable plumbing 45 may be included for drainage purposes, as well as for supplying pressurized water to the sink 40. Suitable controls which may include signal or operational lights, may be provided on a control box, indicated by numeral 46.

The cabinet is completely mobile when in its closed position, as shown in FIG. 1, by means of cabinet wheels 47 and 47' that are carried on both sides of the cabinet and in the front and rear so that the cabinet is completely supported thereon. Brake means may be provided if needed to secure the cabinet at a specific location or site. Also, it is to be noted that the wheels 32 and 33 carried on the front panel portions 26 and 27 operate to wheelably support the cabinet in both its open and closed positions.

Therefore, it can be seen that the novel storage or utility cabinet of the present invention provides a novel means for housing a plurality of serving items in upper and lower storage compartments that are closed when the panels 15 and 25 are in their closed position as shown in FIG. 1. When it is desired to gain access to these areas, as well as to provide a counter across which the items may be served, the panels 15 and 25 are lowered to the position shown in FIG. 2 so that the panel portions 26 and 27 support the L-shaped panel 15. The cut-out area or space between the back side edge of panel portion 17 and the face of cabinet 11, permits serving personnel to stand behind the counter 15 and to have access to the articles and items within the cabinet for ready serving across the counter. It should also be noted that a selected side of the cabinet 11 is notched, as indicated by numeral 48, so as to receive the thickness of the panel 15 at its end terminating in the panel portion 17. Therefore, the panels 15 and 25 will be flush and coextensive with the face of the cabinet 11 when in the closed position as shown in FIG. 1.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A portable storage cabinet comprising the combination of:

an upright wheeled housing having an internal storage compartment;

said housing having a top joining opposite sides to define said internal storage compartment and further including a midsection member extending between said sides to separate said internal storage compartment into an upper compartment and a lower compartment;

an L-shaped upper panel hinged to said midsection member for deployment between a closed position against said housing to cover said upper compartment and an open position outwardly projecting normal to said housing to uncover said upper compartment;

a lower panel hinged to said housing adjacent one of said sides for deployment between a closed position against said housing to cover said lower compartment and an open position outwardly projecting normal to said housing to uncover said lower compartment; and said lower panel including two panel portions hingeably connected together along adjacent ends whereby said lower panel in its open position extends said two panel portions normal to each other to support said L-shaped panel when in its open position.

2. The invention as defined in claim 1 wherein:

said housing includes a notch in the forward face of said top for receiving the thickness of said L-shaped panel when in its closed position; and a selected one of said housing sides having a notch therein for receiving the thickness of said L-shaped panel when in its closed position.

3. The invention as defined in claim 2 wherein:

said L-shaped panel constitutes a serving counter in its deployed open position and said L-shaped panel having an integral return portion extending at a right angle to a major portion hinged to said midsection, said return portion in spaced-apart relationship with respect to said housing midsection member to define an open area intended to be occupied by a server.

4. The invention as defined in claim 3 wherein:

one panel portion of said lower pair of panel portions is disposed in support of said upper panel under said major portion of said upper panel and the other panel portion of said lower pair of panel portions is disposed in support of said upper panel under said return portion of said upper panel, said lower panel portions being in support of said upper panel when said upper panel is in its open position.

* * * * *